United States Patent [19]

Wendt

[11] Patent Number: 4,606,162

[45] Date of Patent: Aug. 19, 1986

[54] ADJUSTABLE GLAZED PARTITION SYSTEM

[75] Inventor: Alan C. Wendt, Barrington, Ill.

[73] Assignee: United States Gypsum Company, Chicago, Ill.

[21] Appl. No.: 642,766

[22] Filed: Aug. 21, 1984

[51] Int. Cl.[4] ..... E04B 1/00; E06B 5/00

[52] U.S. Cl. ..... 52/282; 52/395; 52/468

[58] Field of Search ..... 52/282, 395, 462, 467, 52/468, 470, 776

[56] References Cited

U.S. PATENT DOCUMENTS

| | | | |
|---|---|---|---|
| 3,158,961 | 12/1964 | Hawkins | 50/211 |
| 3,196,992 | 7/1965 | Owen | 189/36 |
| 3,210,808 | 10/1965 | Creager | 20/56.3 |
| 3,893,269 | 7/1975 | Nelsson et al. | 52/282 |
| 4,100,704 | 7/1978 | Dogami | 52/65 |
| 4,251,964 | 2/1981 | Francis | 52/282 |

FOREIGN PATENT DOCUMENTS

| | | | |
|---|---|---|---|
| 693092 | 5/1962 | Italy | 52/282 |

*Primary Examiner*—Billy S. Taylor

*Attorney, Agent, or Firm*—Robert M. Didrick; Samuel Kurlandsky; Robert H. Robinson

[57] ABSTRACT

A glazed partition system adaptable to various angles of intersection comprises an L-shaped mullion having a socket at its upper end in which two opposed glazing rails are pivotable and an arcuate flange at its lower end which releasably engages one glazing rail and slidably engages the opposed glazing rail. The sills 14 and 16 are placed at the desired angles and the glazing rail 38L and the mullion 18 are fastened at right angles to the sills 16 and 14, respectively. The glazing rail 38R is then snapped onto the mullion 18 and the window panes 50L and 50R are set in place. A plurality of similarly shaped pivot clips may be used in place of the elongate mullion.

4 Claims, 4 Drawing Figures

ADJUSTABLE GLAZED PARTITION SYSTEM

This invention relates to the construction of glazed partitions for offices and the like. It relates more particularly to glazed partitions that meet at an oblique angle. It relates still more particularly to an angularly adjustable mullion and a partition system wherein a coupled pair of opposing glazing rails pivot in a socket located on the mullion.

Various proposals have been made for connecting adjacent glazed partitions at oblique angles. Systems for this purpose are shown in U.S. Pat. Nos. 3,210,808 (Creager), 4,251,964 (Francis), 3,158,961 (Hawkins), 4,100,704 (Oogami), and 3,196,992 (Owen). In Creager, two window frames are rotatably attached to a T-shaped mullion whose web portion terminates as a pair of symmetrical open sockets. The window frames each have a ball joint which fit within the sockets of the mullion. As the window frames are moved in relation to each other, an outer flange on each frame slides between two pairs of opposing flanges projecting laterally from the mullion's web. Because the ball joints are separated by the web portion of the mullion, there can be no sharply defined corner between the internal flanges to which the ball joints are connected. The use of the Creager mullion in the construction of an adjustable partion would require not only the fabrication of the special mullion but also the fabrication of specially designed window frames. In Francis, Hawkins, Oogami and Owen, the assembled partitions have gaps at the intersections of the glazing rails or bars and the member upon which they pivot. The corner trim pieces in Francis, Hawkins and Oogami must be different for every angle selected for the intersection of the partitions.

The principal object of this invention is to provide a novel glazing system for window walls that intersect at oblique angles.

A related object of this invention is to provide an angularly adjustable glazing system which incorporates conventional and commercially available glazing rails.

Another related object of this invention is to provide a glazing system wherein the glazing rails meet at a cleanly defined corner which is aesthetically pleasing to the occupants of the room enclosed by oblique window walls.

Still another object of this invention is to provide a glazing system for oblique window walls which does not require separate trim pieces to hide a gap between the mullion and the window frames which articulate with the mullion.

It is yet another related object of this invention to provide a mullion for oblique window walls upon which conventional glazing rails may be pivoted to obtain the desired angle of intersection.

It is a further object of this invention to provide a mullion for oblique window walls which provides by itself the only trim necessary for an aesthically pleasing intersection of the walls.

Other objects, features and advantages of this invention will become apparent from the following detailed description and the attached drawings, wherein.

Figure 1:
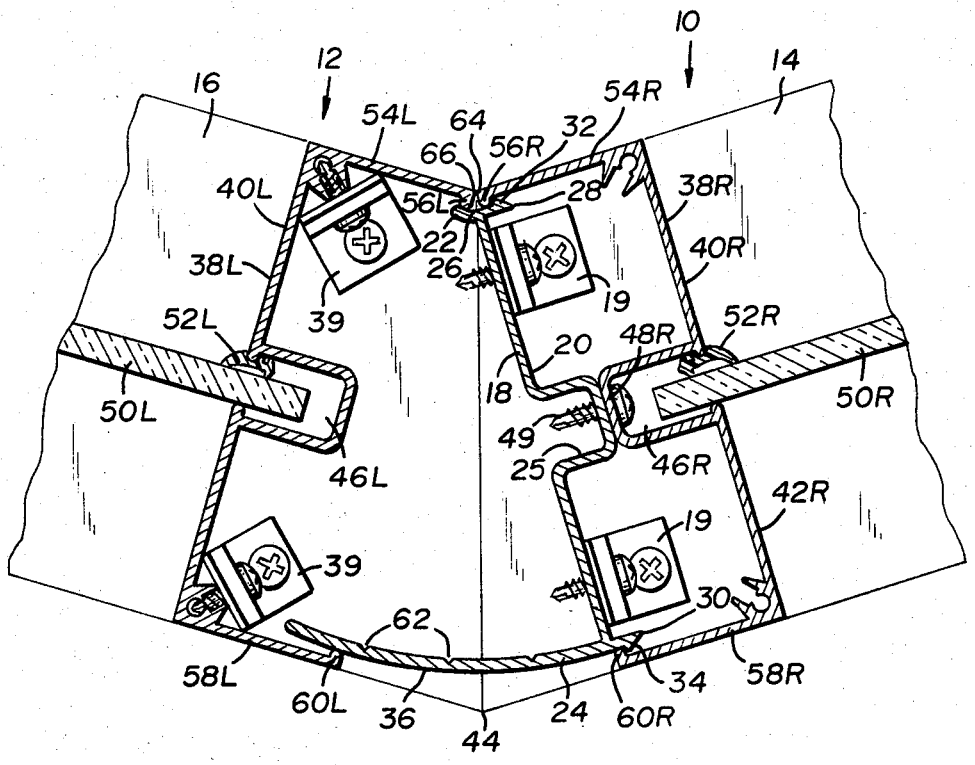
FIG. 1 is a fragmentary, horizontal section of two intersecting partitions employing the glazing system of this invention.
Figure 2:
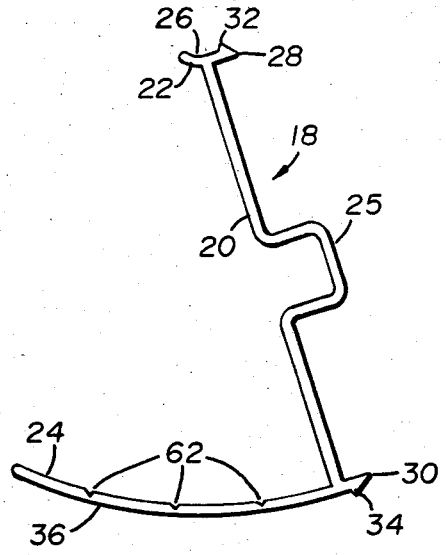
FIG. 2 is a plan view of a mullion employed in the glazing system of FIG. 1.

In FIG. 1, the partitions 10 and 12 rest on the sills 14 and 16, respectively, and are connected at an oblique angle by the elongated, generally L-shaped mullion 18 of FIG. 2 which is attached to the sill 14 by the clips 19. The mullion 18 is made up of a web portion 20, a transverse socket body 22 at one end of the web, and an arcuate flange 24 which extends laterally from the opposite end of the web. The web 20 is bent into a U-shaped segment 25 for convenient placement and attachment to a glazing rail as will be described below. The surface of the socket body 22 has a concave curvature which defines the seat 26 of the socket. The lugs 28 and 30 on the socket body 22 and the flange 24, respectively, have retaining lips 32 and 34 which terminate the concave surface of the seat 26 and the convex surface of the blade portion 36 of the flange 24, respectively. The glazing rail 38R is generally E-shaped, having a posterior web 40R and an anterior web 42R with respect to the apex 44 of the partition intersection. Said webs are joined by a U-shaped pane-receiving channel 46R which has a base 48R connected to the U-shaped segment 25 of the mullion's web 20 by the screw 49. The window pane 50R is secured in the channel 46R by the glazing spline 52R. The inner flange 54R has a perpendicular hook 56R which snaps over the retaining lip 32 of the socket body 22. The outer flange 58R has a perpendicular hook 60R which projects toward the opposite hook 56R and snaps over the retaining lip 34 of the lug 30 on the arcuate flange 24. The glazing rail 38L is attached to the sill 16 by the clips 39 and holds the window pane 50L in the pane-receiving channel 46L by means of the spline 52L which is connected to the posterior web 40L. The inner flange 54L has a perpendicular hook 56L which rests on the seat 26 of the socket body 22 of the mullion 18. The outer flange 58L has a terminal hook 60L upon which the blade 36 bears. The grooves 62 on flange 24 provide convenient snap-off points when the flange must be shortened to fit between the glazing rails 38L and 38R.

The first step in the construction of the intersecting partitions is the anchoring of the sills 14 and 16 and the headers (not shown) to the floor and ceiling, respectively, by conventional means. The sills and headers will have been cut to meet at the angle desired for the particular intersection. The glazing rail 38L is then fastened at right angles to the sill 16 and the corresponding header. The seat 26 of the socket bar 22 of the mullion 18 is then slipped under the hook 56L of the glazing rail 38L and the mullion 18 is moved to line up the web 20 at a right angle to the edges of the sill 14 and the corresponding header. After the mullion is fastened with clips 19 the hooks 56R and 60R of the glazing rail 38R are snapped over the retaining lips 32 and 34, respectively, of the mullion 18. The window panes 50R and 50L may then be put in place.

The opposing ends 64 and 66 of the inner flanges 54R and 54L, respectively, thus become the pivot points of the angularly adjustable glazing system of this invention. Said ends butt together tightly to form a neat seam and hide the innards of the joint between the two partitions.

Figure 3:
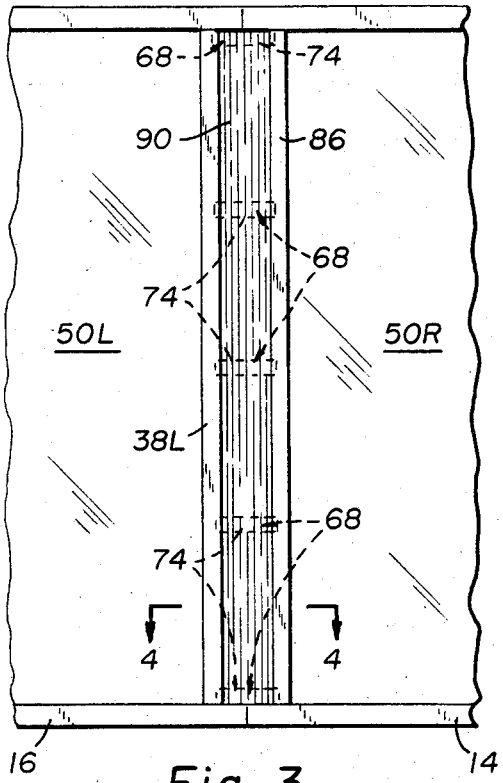
FIG. 3 is an elevational view of a partition intersection employing a plurality of pivot clips as shown in FIG. 4.
Figure 4:
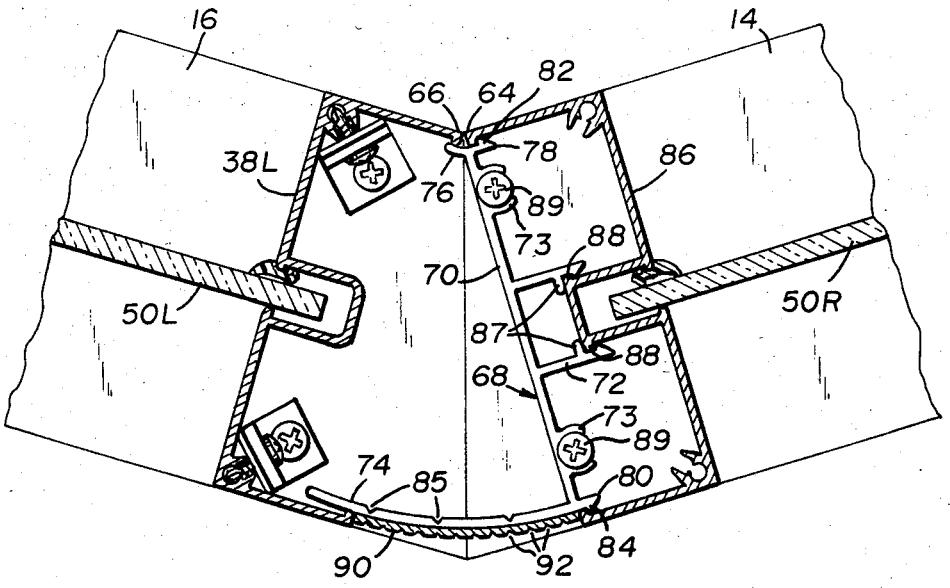
FIG. 4 is a sectional view of the intersecting partitions of FIG. 3 taken along the line 4—4 in FIG. 3.

As shown in FIGS. 3 and 4, the pivot clip 68 represents an alternative means for connecting two glazed partitions so that the angle of their intersection may be adjusted to conform to the floor plan of an office building. Made by the extrusion of aluminum or a structural plastic, the clip 68 is a generally L-shaped bar instead of being the elongated plate described as the mullion 18 in FIG. 1. The clip 68 comprises a first leg 70 having a yoke 72 intermediate therein and attachment shoes 73 on each side of the yoke, an arcuate leg 74 extending laterally from one end of the first leg 70 in the direction opposite to the orientation of the yoke, and a transverse socket bar 76 intersected by the other end of the leg 70. Like their counterparts in the mullion 18, the arcuate leg 74 has a convex surface on the side opposite its juncture with the leg 70 and the socket bar 76 has a concave surface on the side opposite its juncture with the leg 70. The socket bar and the arcuate leg are terminated by the lugs 78 and 80, respectively and the lugs are characterized by the retaining lips 82 and 84. The grooves 85 serve as break off points on the arcuate leg 74.

The intersecting partitions of FIGS. 3 and 4 are mounted by attaching the glazing rail 38L at right angles to the sill 16 and the corresponding header, placing the socket bars 76 of the lower-and upper most pivot clips 68 over the hook 56L of glazing rail 38L and sliding the arcuate legs 74 along the hook 60L of said rail until the first legs 70 are at right angles to the sill 14 and its corresponding header (breaking off segments of the arcuate legs 74 at grooves 85 if necessary), attaching the pivot clips 68 to the sill and header with screws 89, and snapping the rail 86 onto the lips 82 and 84 and the yoke 72 of each clip 68. The stops 87 hold the beads 88 within the yoke 72. After the intermediate pivot clips 68 shown in FIG. 3 are snapped into place along the rail 86, an elongate, curved, corner trim piece 90 having the grooves 92 on its outer surface is fastened to the arcuate legs 74 with an adhesive or a double faced adhesive tape. Again, the grooves 92 serve as break off points when the trim piece 90 must be made narrower to fit the space between the glazing rails. Being on the outer surface, the grooves 92 also impart a pleasing fluted appearance to the corner piece. If a smooth surfaced trim piece is desired, the grooves 92 can be placed on the inside surface.

The angle of intersection of the glazed partition may range from 90° to 180° but the more common angle is about 120° or greater.

While for purposes of illustration, representative embodiments of the invention within the scope of the following claims may become apparent to those skilled in the art.

The subject matter claimed is:

1. A glazing system comprising:

a first and a second generally E-shaped glazing rail coupled in opposing relationship, each rail comprising:

an elongate, U-shaped, pane-receiving channel having a base, a first leg, and a second leg, a posterior web joined to the first leg and an inner flange joined to the posterior web, an anterior web joined to the second leg and an outer flange joined to the anterior web, the inner and outer flanges having opposing terminal hooks which are parallel to their respective webs; and a mullion articulating with and spanning the inner and outer flanges, which comprises:

an elongate web portion attached to the base of the pane-receiving channel of the first glazing rail, a socket body connected transversely to one longitudinal edge of the web portion and having a concave seat with which the inner flange hooks are pivotably engaged, and an arcuate flange connected to the opposite longitudinal edge of the web portion and having a convex outer surface, the arcuate flange releasably attached to the outer flange hook of the first glazing rail and slidably engaged on its convex surface by the outer flange hook of the second glazing rail.

2. The glazing system of claim 1 wherein the web portion of the mullion has a U-shaped segment which abuts the pane-receiving channel of the first glazing rail.

3. The glazing system of claim 1 wherein the inner flanges of the opposing rails meet along a seam defined by the hook ends of said flanges.

4. The glazing system of claim 1 wherein the mullion is characterized further in that the socket body and the arcuate flange have terminal lugs which resiliently engage the inner and outer flange hooks of the first glazing rail.

* * * * *